United States Patent [19]

Wilson et al.

[11] 4,168,829

[45] Sep. 25, 1979

[54] CONTROL VALVE FOR VACUUM SHEET FEEDING APPARATUS

[75] Inventors: William C. Wilson; David B. Anderson, both of Rochester, N.Y.

[73] Assignee: Eastman Kodak Company, Rochester, N.Y.

[21] Appl. No.: 807,991

[22] Filed: Jun. 20, 1977

[51] Int. Cl.[2] ..... B65H 3/10

[52] U.S. Cl. ..... 271/108; 271/99; 271/171

[58] Field of Search ..... 271/96, 108, 94, 95, 271/99, 100, 101, 107, 171, 276, 196; 214/8.5 D

[56] References Cited

U.S. PATENT DOCUMENTS

| | | | |
|---|---|---|---|
| 2,764,407 | 9/1956 | Alix | 271/108 |
| 2,770,458 | 11/1956 | Halahan et al. | 271/99 X |
| 2,841,392 | 7/1958 | Norton | 271/108 |
| 3,476,382 | 11/1969 | Tregay et al. | 271/240 |
| 3,500,999 | 3/1970 | Lippke | 271/197 X |
| 3,533,618 | 10/1970 | Carstens | 271/96 X |
| 3,617,048 | 11/1971 | Albert | 271/108 |
| 3,674,255 | 7/1972 | Arnell | 271/99 X |
| 3,851,871 | 12/1974 | Aronson | 271/95 X |

*Primary Examiner*—Bruce H. Stoner, Jr.
*Attorney, Agent, or Firm*—Lawrence P. Kessler

[57] ABSTRACT

A mechanism for positioning a control valve for an oscillating vacuum feeder which automatically adjusts the position of the control valve in relation to the width of the sheets to be fed. The mechanism includes at least one coupler member selectively engageable by the side guides which align the opposing marginal edges of the stack of sheets to be fed from a sheet supply hopper. The control valve, located within the oscillating vacuum feeder adjacent the outboard ports thereof, has an outwardly extending arm which passes through a longitudinal slot in the feeder. The arm is captured by the coupler member whereby movement of the side guides will be directly imparted to the valve through the coupler member to position the valve for controlling opening or closing of the outboard ports.

4 Claims, 5 Drawing Figures

CONTROL VALVE FOR VACUUM SHEET FEEDING APPARATUS

BACKGROUND OF THE INVENTION

1. Field of the Invention

This invention is related to a vacuum sheet feeding apparatus and more particularly to a selectively movable valve for controlling the area of vacuum application transverse to the sheet feed path of a sheet feeding apparatus, the position of the valve being dependent upon the size of the sheets being fed.

2. Description of the Prior Art

In the copier/duplicator field, it is well known to feed sheets from a stack seriatim by vacuum pick-off apparatus. While intermittently moving fingers or sucker arms have been used in the past, more recently oscillating (or rotating) vacuum cylinders have been utilized for sheet feeding in order to achieve higher operational speeds. Generally, the oscillating or rotating vacuum cylinder feed apparatus include a ported cylindrical housing in juxtaposition with a stack of sheets to be fed. A vacuum source connected to the housing creates a reduced pressure atmosphere which induces the tacking of a sheet to the surface thereof and holds it there while the rotation of the housing strips the sheet from the stack and delivers the sheet to a downstream feeding mechanism.

If a vacuum feed apparatus is required to handle sheets of varying widths (in the transverse direction to the sheet feed path), care must be taken to insure that all open ports in the housing are covered by a sheet being fed or the effectiveness of the vacuum may be lost. To accomplish this end, the ports may be located only within the marginal dimension of the narrowest sheet to be fed, or a valve may be provided to close the outboard ports when a sheet of narrower dimension is being fed. If the ports are located within the narrowest marginal dimension of a sheet to be fed, the outside marginal edges of wider sheets will now be under vacuum control during feeding and may cause jamming of the feeder. On the other hand, a valve to control outboard ports has heretofore required operator intervention during the feed cycle to assure proper setting of the valve dependent on the size of sheets being fed.

SUMMARY OF THE INVENTION

Accordingly, it is the purpose of this invention to provide a mechanism for positioning a control valve for an oscillating vacuum feeder which automatically adjusts the position of the control valve in relation to the width of the sheets to be fed. The mechanism includes at least one coupler member selectively engageable by the side guides which align the opposing marginal edges of the stack of sheets to be fed from a sheet supply hopper. The valve, located within the oscillating vacuum feeder adjacent the outboard ports thereof, has an outwardly extending arm which passes through a longitudinal slot in the feeder. The arm is captured by the coupler member whereby movement of the side guides will be directly imparted to the valve through the coupler member to position the valve for controlling the opening or closing of the outboard ports.

DESCRIPTION OF THE PREFERRED EMBODIMENTS

Figure 1:
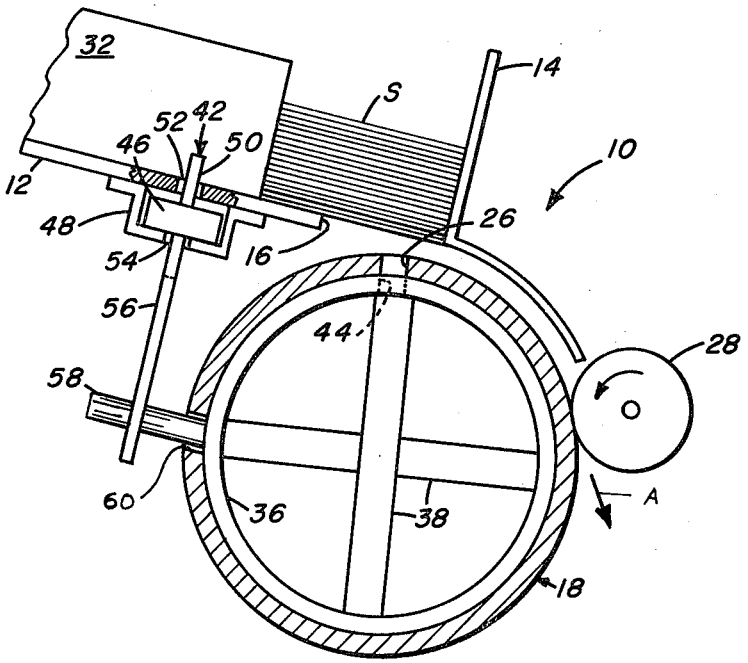
FIGS. 1 and 1A are side elevational views, partly in section, of a sheet feeding apparatus incorporating the vacuum controlling valve of this invention shown at different times in the sheet feeding cycle.

The sheet feeding apparatus 10 shown in FIG. 1 (1A) includes a support 12 for a stack of sheets S. The width of a stack of sheets S in the direction transverse to the direction of feed may range from, for example, 8 inches to 17 inches. For simplicity the 8 inch width sheet stack will hereinafter be referred to as the first size (see FIG. 2) and the wider 17 inch width sheet stack will be referred to as the second size (see FIG. 3). The support 12 is inclined relative to horizontal so that the stack of sheets S will, under the influence of gravity, abut a forward wall 14 thereof for uniform positioning of the lead edge of the sheets. An opening 16 in the support 12 adjacent the forward wall exposes the bottom most sheet of the stack to the feed mechanism of the sheet feeding apparatus 10.

Figure 1A:
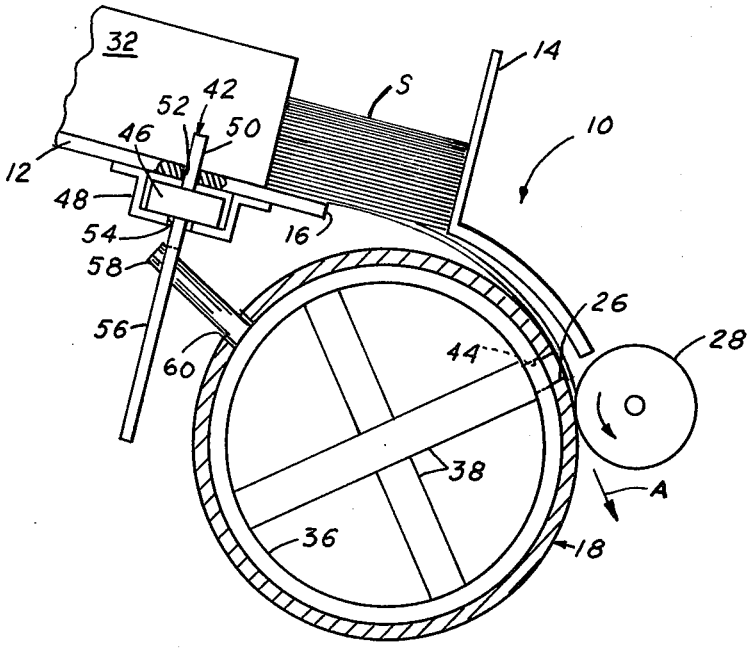

The feed mechanism includes an oscillating vacuum feeder 18 positioned immediately beneath the opening 16 to feed sheets from the bottom of the stack. The oscillating vacuum feeder 18 has a cylindrical housing 20 with a sealing end cap 22 at one end and a connector 24 at the other end defining a vacuum chamber. The connector 24 is in communication by any appropriate means with a vacuum source (not shown) to establish a partial vacuum within the housing 20. The housing 20 has a series of ports 26, 26' through the wall of the housing communicating with the interior chamber of the housing providing flow communication paths to enable the vacuum established within the chamber to be effective to tack the bottom most sheet in the stack to the outer peripheral surface of the housing when the ports are located immediately beneath the stack. The housing 20 is oscillated clockwise through an angle of approximately 60° (from the position shown in FIG. 1 to the position shown in FIG. 1A) to carry the leading edge of a tacked sheet from the stack to a nip roller 28. Circumferential bearings 30 (see FIGS. 2 or 3) carried by the housing 20 cooperate with the roller 28 to enable the roller to feed a sheet carried by the housing 20 in the direction of the arrow A from the housing to a downstream feed path at the same time the housing oscillates in the counterclockwise direction (when viewed as in FIG. 1A) to return the ports 26, 26', to the position beneath the stack S (FIG. 1) for a subsequent feeding cycle.

Side guides 32, slidably mounted on the support 12 by any conventional means (see for example U.S. Pat. No. 3,339,916) are provided to align the opposing marginal edges of the stack of sheets S to centrally position the stack laterally on the support relative to the direction of feed. The guides 32 are adjustable from the position of FIG. 2 for feeding the first width stack of sheets to the position of FIG. 3 for feeding the second width stack of sheets. To exert proper control over marginal edges of the sheets of the second size, a selectively actuated control valve 34 within the housing 20 regulates the opening of outboard ports 26'. The ports 26' are opened so as to enable the vacuum within the housing 20 to be effective to control the outboard marginal edges only when second size sheets are to be fed, and are maintained closed when feeding narrower first size sheets to prevent loss of vacuum.

Figure 2:
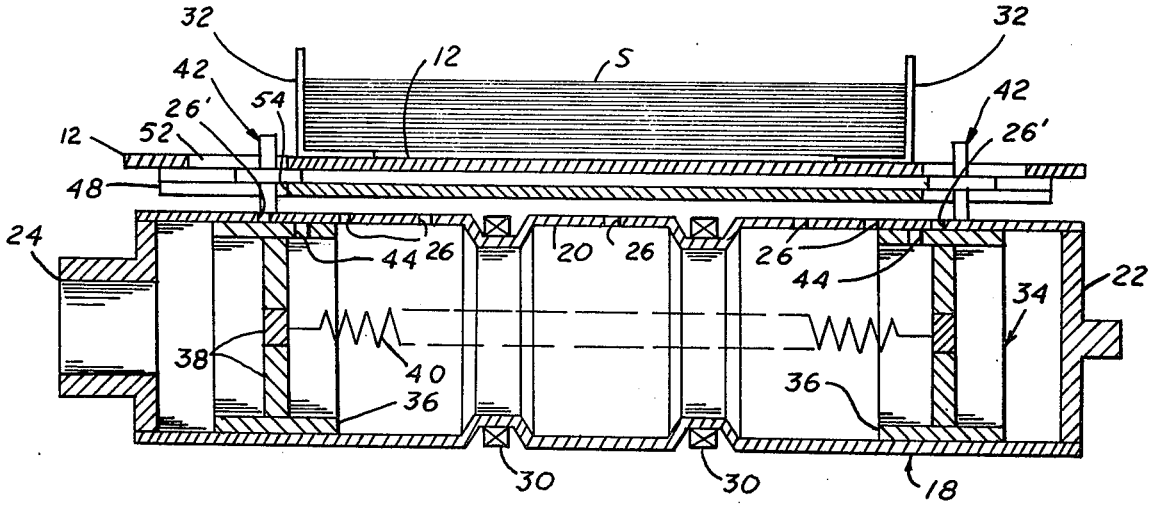
FIG. 2 is a front elevational view, partly in section, of the apparatus of FIG. 1, with the apparatus in position to feed sheets of a first size.
Figure 4:
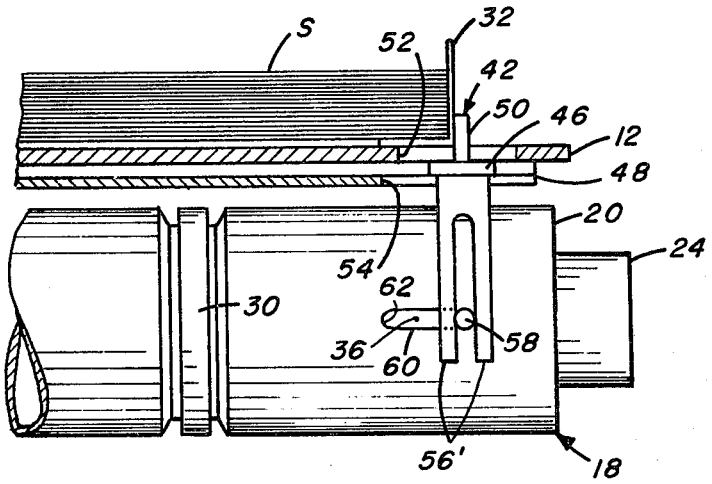
FIG. 4 is a rear elevational view of a portion of the apparatus of FIG. 1.

The valve 34 has a pair of cylindrical sleeves 36, each sleeve having a port 44 therethrough. The sleeves 36 conform to the internal peripheral surface of the housing 20 and are in slidable friction engagement therewith. Pins 58 (see FIG. 4) extending outwardly from the sleeves 36 through axial slots 60 in the housing cause the sleeves to oscillate with the housing. Each of the sleeves 36 has internal spokes 38 and a helical spring 40 is connected between the spokes of the opposed sleeves 36. The spring constant of the spring 40 is selected so as to enable the spring to overcome the frictional forces between the housing 20 and the sleeves 36 so that the sleeves will be constantly urged toward the center of the housing. When the sleeves are in their center-most position, as shown in FIG. 2, each of the sleeves 36 will block its respective outboard port 26' whereby vacuum leakage therethrough will be prevented and first size sheets may be effectively fed.

Figure 3:
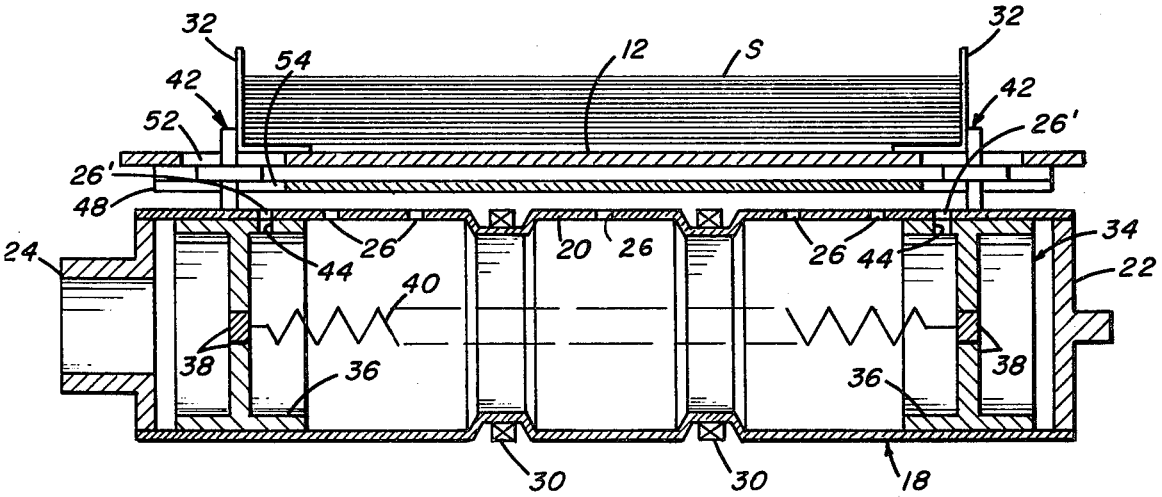
FIG. 3 is a front elevational view, partly in section, similar to FIG. 2, with the apparatus in position to feed sheets of a second size.

When sheets from the second width stack are to be fed by the feeder 18, the side guides 32 are moved outwardly to the position of FIG. 3 to accommodate the wider second size sheets. Couplers 42 are provided to transmit the movement of the side guides 32 to the sleeves 36 of the valve 34 to move the sleeves to the outboard position of FIG. 3. In their outboard position, the sleeves 36 underlie the outboard ports 26' such that ports 44 in the sleeves will be aligned with respective ports 26' in the housing 20. The vacuum within the chamber of the housing 20 will thus be operative to tack the outer marginal edges of the second size sheets to the outer peripheral surface of housing 20 so that the sheets are maintained under positive control during the feed cycle.

Each of the couplers 42 (only one being shown in FIGS. 1, 1A and 4) include a slide 46 supported in a U-shaped channel 48 fixed to the underside of the support 12. A pin 50 extends upwardly from the slide 46 through a slot 52 in the support 12. Extending downwardly from the slide 46, through a slot 54 in the channel 48, is a yoke 56. The legs 56' of the yoke capture a pin 58 (see FIG. 4) extending outwardly from the sleeve 36 through a slot 60 in the housing 20 over the entire period of oscillation of the housing. The slots 60 are positioned to limit the movement of the respective couplers 42 and, thus, the sleeves 36. When the side guides 32 are positioned to align a stack of first size sheets, the couplers 42 will be located with the inboard edges 62 of the slots 60 limiting the inward movement of the respective pins 58 of the sleeves 36 (urged in the inward direction by spring 40 to the position of FIG. 2 as described above). Limiting the inward movement of the couplers 42 is desireable to release the forces exerted on the side guides 32 by the couplers, such that the guides may be easily positioned for aligning the first size sheets without interference from such forces.

When the side guides 32 are positioned to align the second width stack of sheets, the engagement of the side guides with the upstanding pins 50 will move the couplers 42 to the position of FIG. 3. The pins 58 of the sleeves 36 will thus be moved outwardly to engage the outboard edge of the slots 60. Movement of the pins 58, of course, moves the sleeves 36 to the position of FIG. 3 (against the urging of spring 40). In this manner repeatable positioning of the sleeves 36 in the position of FIG. 3 is assured. When the sleeves 36 are in their outboard position, the port 44 in each sleeve will be aligned with respective ports 26' in the housing 20. As noted above, the vacuum will thus be effective to tack marginal edges of the second size sheets to the outer peripheral surface of the housing 20 in order to maintain positive control over the sheets as they are fed from the stack by oscillation of the housing between FIG. 1 and FIG. 1A.

From the foregoing it is apparent that there is herein provided a valve for an oscillating vacuum feeder which assures positive control over sheets fed seriatim by the feeder from sheet stacks of various widths. The sheet stacks are located on a support by movable side guides which align the opposing marginal edges of the sheet stacks. An internal valve selectively opens and closes outboard ports in the feeder to establish vacuum control of the marginal edges of certain size sheets to be fed by the feeder, and to prevent loss of vacuum when certain other size sheets are to be fed. The positioning of the internal valve is directly responsive to movement of the side guides, whereby the effective position of the valve is established when the position of the side guides is changed for aligning different width stacks of sheets.

The invention has been described in detail with particular reference to preferred embodiment thereof, but it will be understood that variations and modifications can be effected within the spirit and scope of the invention.

We claim:

1. Apparatus for feeding sheets from stacks of different widths, said apparatus comprising:

means for supporting a stack and including movable side guides for engaging and aligning opposed marginal edges of the sheets of such stack;

a vacuum feeder for feeding sheets seriatim from such stack and including a cylindrical housing defining a vacuum chamber having concentric internal and external peripheral surfaces and a series of ports providing flow communication paths between said internal and external peripheral surfaces for tacking a sheet to said external peripheral surface;

a control valve within said housing having an external surface conforming to said internal peripheral surface and being movable between a first position in which the path of at least one of the ports of said series of ports is closed by the external surface of said control valve, and a second position in which said control valve external surface is removed from the path of said one port to open said one port; and means interconnecting said side guides and said control valve for moving said control valve to said first or second position in response to movement of said side guides, such that the opening and closing of said one port relates directly to the width of the sheets in such stack engaged by the side guides.

2. The invention according to claim 1 wherein said means interconnecting said side guides and said control valve includes a coupling member engageable by at least one of said side guides, a yoke extending from said coupling member in proximity to said housing, a slot in said housing adjacent to said yoke, and an arm extending outwardly from said control valve through said slot to be captured by said yoke.

3. The invention according to claim 1 wherein said internal control valve comprises a pair of sleeves complimentary to and in frictional engagement with the internal peripheral surface of said chamber of said housing, therebeing at least one port in each of said sleeves, said sleeves being located so as to block the outermost ports of said series of ports in said housing when said control valve is in its first position, and having the ports in said sleeves aligned with the outermost ports of said series of ports in said housing when said control valve is in its second position.

4. The invention according to claim 3 wherein said internal control valve further includes means for overcoming the frictional engagement between said sleeves and the internal peripheral surface of said chamber of said housing so as to urge said sleeves toward one another.

* * * * *